US012139240B2

(12) United States Patent
Takeshige et al.

(10) Patent No.: US 12,139,240 B2
(45) Date of Patent: Nov. 12, 2024

(54) OUTBOARD MOTOR

(71) Applicant: HONDA MOTOR CO., LTD., Tokyo (JP)

(72) Inventors: Takamasa Takeshige, Wako (JP); Naoki Aikawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 441 days.

(21) Appl. No.: 17/615,845

(22) PCT Filed: Jun. 7, 2019

(86) PCT No.: PCT/JP2019/022831
§ 371 (c)(1),
(2) Date: Dec. 2, 2021

(87) PCT Pub. No.: WO2020/246045
PCT Pub. Date: Dec. 10, 2020

(65) Prior Publication Data

US 2022/0306252 A1 Sep. 29, 2022

(51) Int. Cl.
*B63B 79/30* (2020.01)
*B63B 79/40* (2020.01)
*B63H 20/14* (2006.01)

(52) U.S. Cl.
CPC ..... *B63B 79/30* (2020.01); *B63B 79/40* (2020.01); *B63H 20/14* (2013.01)

(58) Field of Classification Search
CPC ..... B63B 79/30; B63B 79/40; B63H 20/14
See application file for complete search history.

(56) References Cited

U.S. PATENT DOCUMENTS

2006/0046585 A1* 3/2006 Harada ..... B63H 21/213 440/84
2006/0089064 A1* 4/2006 Takada ..... B63H 23/30 440/86
2006/0128236 A1* 6/2006 Mizuguchi ..... B63H 20/14 440/86

(Continued)

FOREIGN PATENT DOCUMENTS

JP 2006-62478 3/2006
JP 2006062478 A * 3/2006 ..... B63H 21/213
JP 2006-117194 5/2006

(Continued)

OTHER PUBLICATIONS

International Search Report and Written Opinion for International Application No. PCT/JP2019/022831 mailed on Aug. 27, 2019, 10 pages.

*Primary Examiner* — S. Joseph Morano
*Assistant Examiner* — Jovon E Hayes
(74) *Attorney, Agent, or Firm* — Amin, Turocy & Watson, LLP

(57) ABSTRACT

An outboard motor that has an actuator and a gear change mechanism. The outboard motor also comprises an operation position sensor that detects the operation position of an operation part, a shift position detection unit that detects the actual shift position of the gear shift mechanism, an actuator detection unit that detects the state of the actuator, and a control device. The control device performs failure determination or drive control of the actuator on the basis of at least two pieces of the detected information.

8 Claims, 6 Drawing Sheets

(56) References Cited

U.S. PATENT DOCUMENTS

| | | | | |
|---|---|---|---|---|
| 2009/0215336 | A1* | 8/2009 | Suzuki | B63H 23/08 440/86 |

FOREIGN PATENT DOCUMENTS

| | | | | | |
|---|---|---|---|---|---|
| JP | 2006-168467 | | | 6/2006 | |
| JP | 2006168467 | A | * | 6/2006 | B63H 20/00 |
| JP | 2009-197952 | | | 9/2009 | |
| JP | 2009197952 | A | * | 9/2009 | B63H 21/213 |
| WO | WO-2020246045 | A1 | * | 12/2020 | B63B 79/30 |

* cited by examiner

OUTBOARD MOTOR

TECHNICAL FIELD

The present invention relates to an outboard motor in which a transmission mechanism is operated by an actuator.

BACKGROUND ART

In an outboard motor, the speed change of a transmission mechanism is performed by an operation of a vessel operator. For example, shift switching such as forward, neutral, and reverse is performed. When a shift mechanism having an electric actuator is used, even a beginner can comfortably perform shift switching. However, as compared with the conventional mechanical cable shift mechanism, there is a disadvantage that the vessel operator cannot recognize an operational feeling.

For this reason, for example, JP 2006-117194 A discloses an outboard motor having a control unit (ECU) that eliminates the influence of aging and manufacturing variations of the shift mechanism and accurately detects completion of a shift change.

SUMMARY OF THE INVENTION

Incidentally, the control device of an outboard motor needs to not only detect completion of a shift change but also perform control corresponding to various situations occurring in the outboard motor. For example, it is important to detect a failure of a component related to the transmission mechanism, detect shift disengagement in which a clutch is disengaged from a gear of the transmission mechanism, and monitor a state during a shift-in.

The present invention relates to a technology of an outboard motor in which a transmission mechanism is operated by the actuator, and an object of the present invention is to provide an outboard motor capable of performing control corresponding to various situations by monitoring a shift state more satisfactorily.

In order to achieve the above object, according to an aspect of the present invention, there is provided an outboard motor including an actuator configured to operate based on an operation of an operating portion performed by a user, and a transmission mechanism configured to change a rotational output of an internal combustion engine based on an operation of the actuator, the outboard motor comprising: an operation position detection unit configured to detect an operation position of the operating portion; a shift position detection unit configured to detect an actual shift position of the transmission mechanism; an actuator detection unit configured to detect a state of the actuator; and a control unit configured to acquire the operation position, the actual shift position, and the state of the actuator, which are pieces of detection information, to perform processing, wherein the control unit performs failure determination or drive control of the actuator based on at least two pieces of detection information among the pieces of detection information.

DESCRIPTION OF THE INVENTION

A preferred embodiment of the present invention will be presented and described in detail below with reference to the accompanying drawings.

Figure 1:
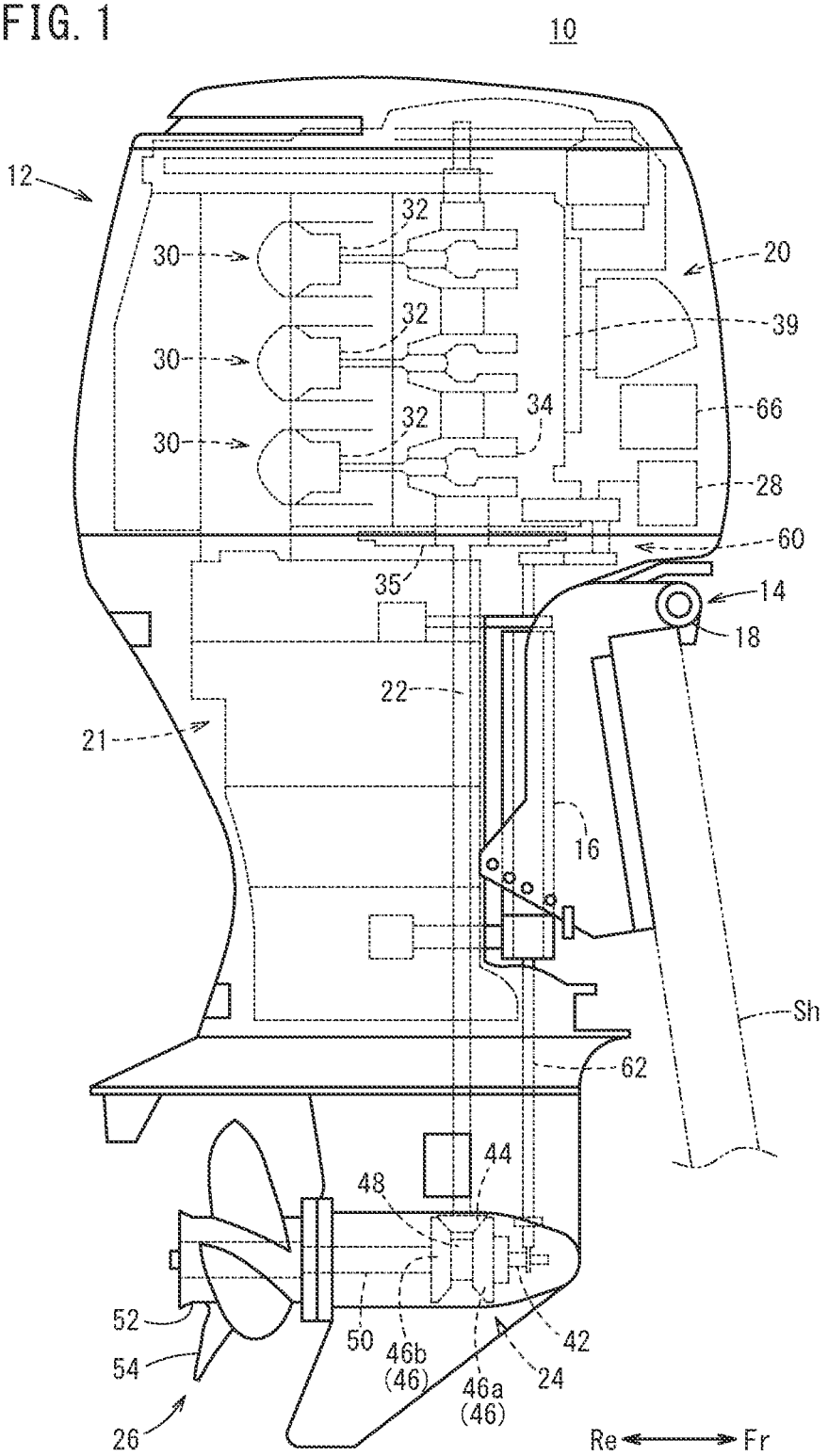
FIG. 1 is a side view showing an overall configuration of an outboard motor according to an embodiment of the present invention.

As shown in FIG. 1, an outboard motor 10 according to an embodiment is attached to a hull Sh as a power source of a small vessel or the like, and is operated and driven by a vessel operator (user) to propel the hull Sh. The outboard motor 10 includes a cover 12 that houses respective components of the outboard motor 10, and a mounting mechanism 14 that fixes the outboard motor 10 to the hull Sh at a front portion of the cover 12.

The mounting mechanism 14 allows the outboard motor 10 to swing left and right about a swivel shaft 16 in plan view, and allows the cover 12 to revolve clockwise or counterclockwise in FIG. 1 about a tilt shaft 18. In the outboard motor 10 in a state in which the up-down direction of the cover 12 extends in the substantially vertical direction, a propeller (fins 54) is located below the water surface.

An engine 20 (internal combustion engine), a drive shaft 22, a transmission mechanism 24, a propeller mechanism 26, and a control device 28 are housed in the cover 12. Further, the outboard motor 10 includes, on a lower side of the engine 20, an exhaust system (not shown) that causes exhaust gas from the engine 20 to flow, and a cooling structure 21 that cools the engine 20 and the exhaust gas.

The engine 20 is a multi-cylinder engine (for example, a V-type engine) including a plurality of cylinders 30 along the up-down direction (vertical direction) of the outboard motor 10. In the engine 20, the axis line of each cylinder 30 is arranged laterally (substantially horizontally), and a crankshaft 34 coupled to a connecting rod 32 of each cylinder 30 extends in the up-down direction.

Further, the engine 20 includes an engine body 39 that houses the connecting rods 32 and the crankshaft 34. A flywheel 35 is coupled to a lower end portion of the crankshaft 34 of the engine 20. An upper end of the drive shaft 22 is coupled to a portion below the flywheel 35. The drive shaft 22 extends in the up-down direction in the cover 12 and is rotatable about its axis. A lower end of the drive shaft 22 is housed in the transmission mechanism 24.

Rotational motion is transmitted from a shift mechanism 60 provided at a position near the engine 20 to the transmission mechanism 24 via an operation shaft 62. The transmission mechanism 24 shifts (changes) a rotational output of the engine 20 based on the rotation of the operation shaft 62. In the present specification, "shift" is an expression including switching of the traveling direction (forward, neutral, reverse) of the hull Sh.

Specifically, the transmission mechanism 24 moves a shift slider 42 forward and backward along the axial direction of the propeller mechanism 26 (propeller shaft 50) based on the rotation of the operation shaft 62. Accordingly, the shift slider 42 moves a dog clutch 48 between a pair of driven bevel gears 46 (a forward driven bevel gear 46*a* and a backward driven bevel gear 46*b*) that mesh with a driving bevel gear 44 coupled to the drive shaft 22. Then, a tooth surface of the dog clutch 48 that has moved engages with one of an inner tooth surface of the forward driven bevel gear 46*a* or an inner tooth surface of the backward driven bevel gear 46*b*. Thus, the driving force of the engine 20 is transmitted to the propeller mechanism 26 via the dog clutch 48 and the propeller shaft 50 described later.

The propeller mechanism 26 includes a tubular propeller shaft 50 into which the shift slider 42 is inserted, a tubular body 52 coupled to a radially outer side of the propeller shaft 50, and the plurality of fins 54 coupled to an outer peripheral surface of the tubular body 52. The propeller mechanism 26 rotates the respective fins 54 clockwise or counterclockwise about the propeller shaft 50 which rotates via the transmission mechanism 24, thereby moving the hull Sh forward or backward.

Figure 2:
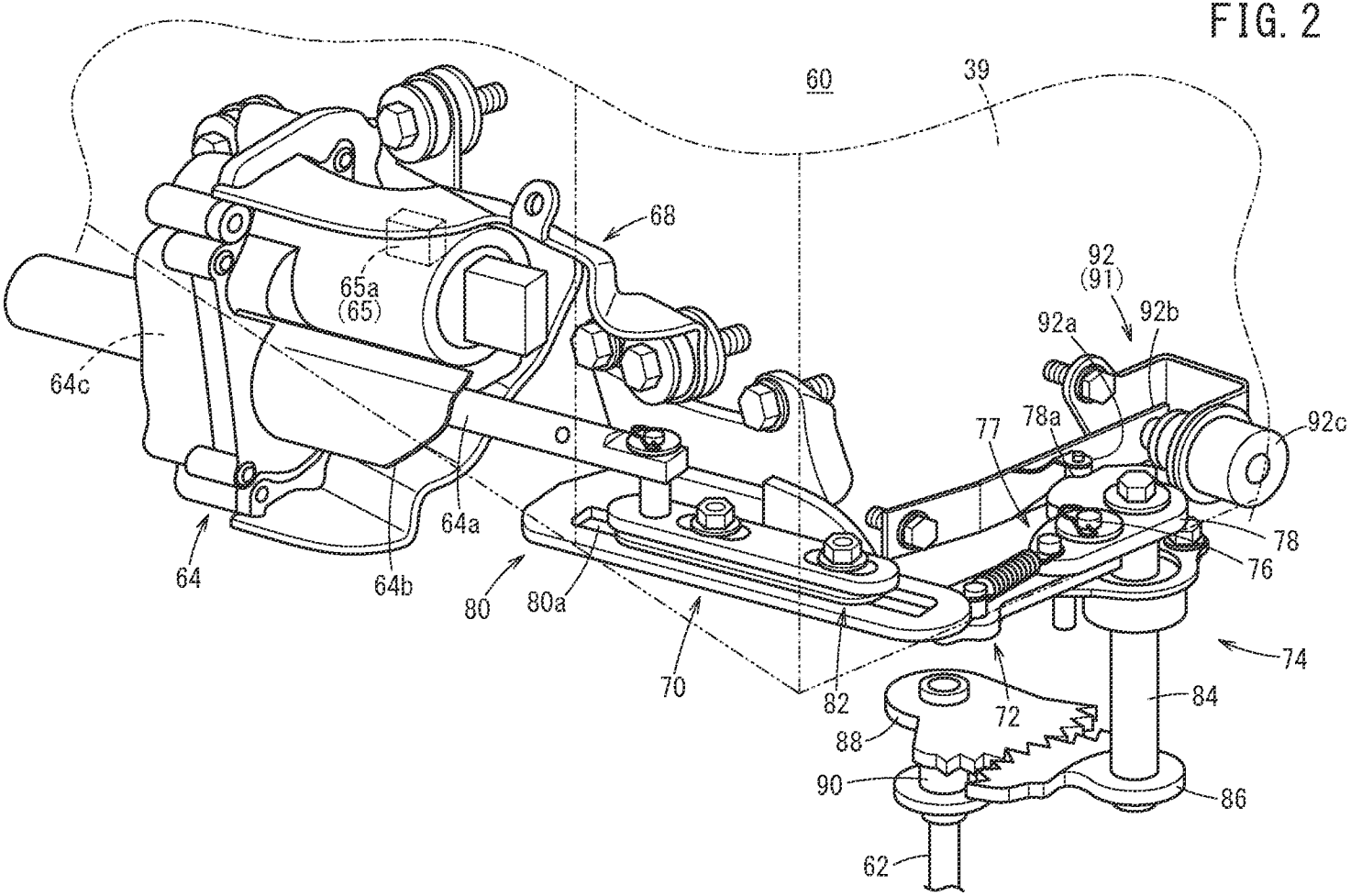
FIG. 2 is a perspective view showing a shift mechanism of the outboard motor.

Next, the shift mechanism 60 that performs shift switching of the transmission mechanism 24 will be described in detail. As shown in FIG. 2, a main mechanism portion of the shift mechanism 60 is fixed to a lower part of a side and front portion of the engine 20 of the outboard motor 10.

The shift mechanism 60 includes an electric actuator 64 (hereinafter also referred to simply as the actuator 64) that receives, without via a cable, an operation signal of an operating portion 94 (shift lever: see FIG. 3) operated by the user, and rotates the operation shaft 62. That is, the control device 28 linearly moves a movable rod 64*a* (movable portion) of the actuator 64 based on the operating portion 94 (an electrical signal, a wireless signal, or the like thereof) described later. The shift mechanism 60 rotates the operation shaft 62 by converting the linear motion into rotational motion.

Specifically, the shift mechanism 60 includes, in addition to the actuator 64, an actuator bracket 68 that fixes the actuator 64 to the engine body 39, a guide structure 70 that guides linear motion, and a link rod 72 and a shift shaft portion 74 that convert linear motion into rotational motion.

The actuator 64 includes the movable rod 64*a*, a housing 64*b* that houses the movable rod 64*a* in a manner that the movable rod 64*a* is able to advance and retreat, and a drive mechanism 64*c* that is provided in the housing 64*b* and moves the movable rod 64*a*. Further, a magnetic sensor 65*a* (actuator detection unit 65) that detects a movement position of the movable rod 64*a* is attached to a front end portion of the housing 64*b*.

The movable rod 64*a* is formed in a rod shape extending linearly with a constant thickness, and a distal end portion (extending end) thereof is connected to the guide structure 70. The drive mechanism 64*c* is formed of, for example, a motor and a ball screw mechanism that converts rotation of the motor into linear motion of the movable rod 64*a* (both not shown). By the drive of the drive mechanism 64*c*, the position of the movable rod 64*a* is basically switched to a first position at which the movable rod 64*a* arrives after moving most in a direction toward the distal end, a second position in the middle of the movement stroke, and a third position at which the movable rod 64*a* arrives after moving most in a direction toward the proximal end.

The magnetic sensor 65*a* detects the movement position of the movable rod 64*a* (the state of the actuator 64) by detecting magnetism of a magnet (not shown) provided at an appropriate position (for example, the distal end portion) of the movable rod 64*a*. The movement position of the movable rod 64*a* is output from the magnetic sensor 65*a* to the control device 28 as information concerning a voltage value corresponding to the detected magnetism. Hereinafter, the detection information (voltage value) transmitted by the actuator detection unit 65 is also referred to as an actuator position AP.

More specifically, the magnetic sensor 65*a* outputs a neutral voltage value corresponding to the second position of the movable rod 64*a*. When the movable rod 64*a* moves forward to move the hull Sh forward, the magnet moves away from the magnetic sensor 65*a*, whereby the magnetic sensor 65*a* outputs a forward voltage value lower than the neutral voltage value, as the first position of the movable rod 64*a*. On the other hand, when the movable rod 64*a* moves backward to move the hull Sh backward, the magnet approaches the magnetic sensor 65*a*, whereby the magnetic sensor 65*a* outputs a reverse voltage value higher than the neutral voltage value, as the third position of the movable rod 64*a*.

The guide structure 70 includes a guide body 80 fixed to the engine body 39, and a sliding body 82 coupling between the movable rod 64*a* and the link rod 72 and sliding along a guide opening part 80*a* of the guide body 80, and the guide structure 70 guides the movement of the distal end portion of the movable rod 64*a*.

The link rod 72 is formed in a substantially V-shape in plan view, and has a portion extending in a first direction and fixed to the sliding body 82 of the guide structure 70, and a portion extending in a second direction and extending in the lateral direction of the guide structure 70. A link pin 76 is coupled to the extending end in the second direction. A shift arm 78 of the shift shaft portion 74 is connected to the extending end in the second direction via the link pin 76.

Figure 3:
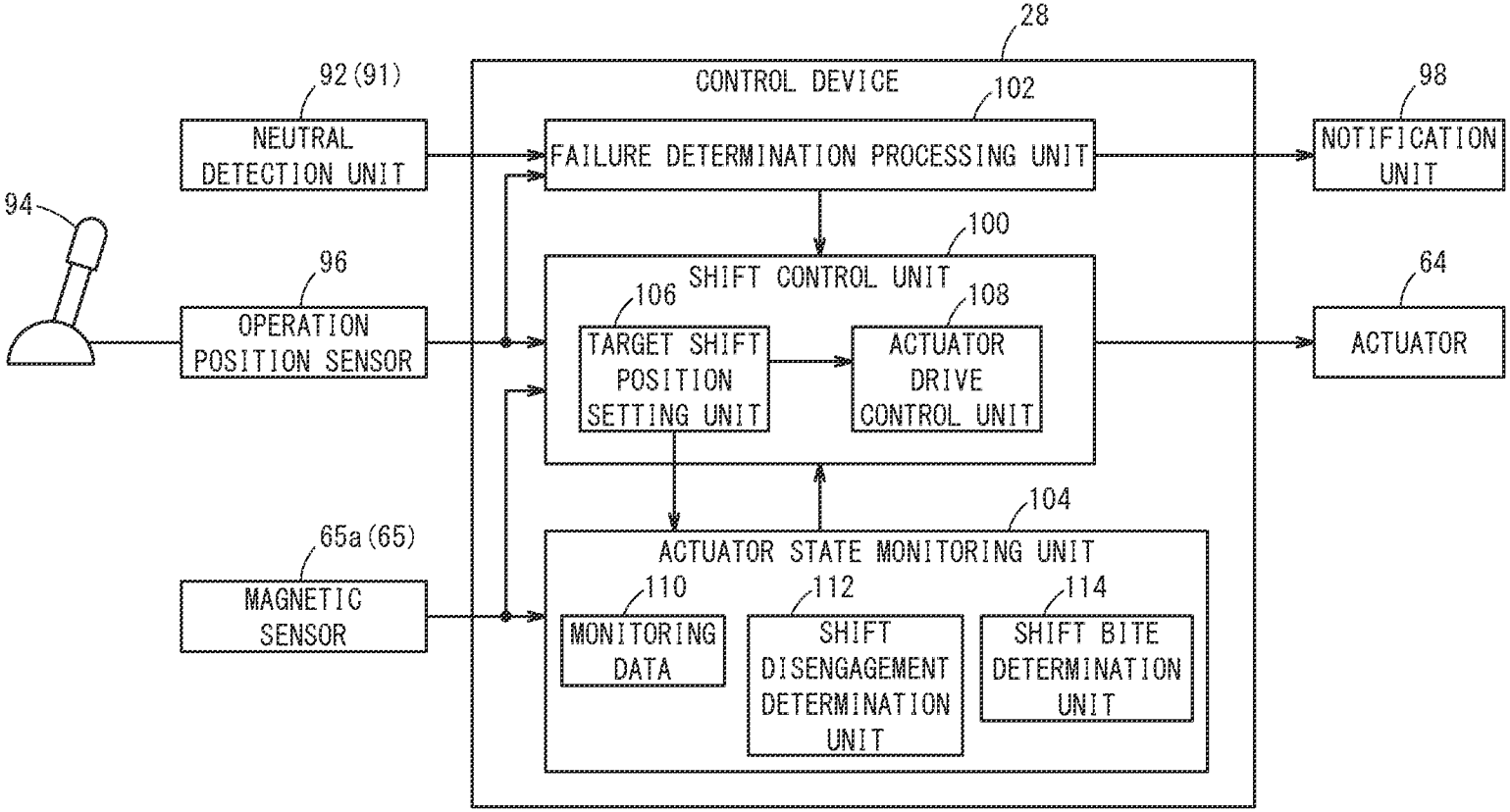
FIG. 3 is a block diagram showing functional units of a control device.

The shift shaft portion 74 includes the shift arm 78, a first shift shaft 84, a first gear 86, a second gear 88, a second shift shaft 90, and a neutral detection unit 92 (shift position detection unit 91: see FIG. 3).

The shift arm 78 is rotatable about a rotation center portion to which the first shift shaft 84 is connected. The shift arm 78 has an elongated link hole (not shown) into which the link pin 76 is movably inserted. That is, linear motion of the link rod 72 is converted into rotational motion of the shift arm 78 by a link connection structure 77 including the link pin 76 and the link hole. For example, when the transmission mechanism 24 is in the neutral position, the link pin 76 is positioned in the link hole closer to the rotation center portion. When the link rod 72 moves forward or backward, the link pin 76 moves in the link hole in a direction away from the rotation center portion. The shift arm 78 rotates clockwise or counterclockwise about the rotation center portion as the link pin 76 moves.

The neutral detection unit 92 includes a contact 92*a*, an elastic plate 92*b* that elastically supports the contact 92*a*, and a switch sensor 92*c* disposed at the other end of the elastic plate 92*b*. When the movable rod 64*a* is in the neutral position, the contact 92*a* is inserted into a recess 78*a* of the shift arm 78.

One end of the elastic plate 92*b* is fixed to the engine body 39, and the other end thereof is a free end. When the contact 92*a* is located outside the recess 78*a*, the other end of the elastic plate 92*b* is separated from the detection unit, whereby the switch sensor 92*c* is turned off. When the contact 92*a* is located in the recess 78*a*, the other end of the elastic plate 92*b* comes into contact with the detection unit, whereby the switch sensor 92*c* is turned on. The switch sensor 92*c* transmits information indicating detection of this ON/OFF to the control device 28.

Next, returning to FIG. 1, the configuration of the control device 28 (control unit) according to the present embodiment will be described. The control device 28 is constituted by a computer (ECU) including a processor, a memory, and an input/output interface (all not shown). The control device 28 controls the operation of the outboard motor 10 by causing the processor to execute a program stored in the memory in advance.

As shown in FIG. 3, an operation position sensor 96 that detects an operation position OP of the operating portion 94 of the outboard motor 10, the magnetic sensor 65*a*, and the neutral detection unit 92 are communicably connected to the control device 28. Further, the control device 28 is connected to a notification unit 98 provided in the outboard motor 10.

The operating portion 94 of the outboard motor 10 is, for example, a shift lever whose angle is manually adjusted by the user. In this case, the operation position sensor 96 is an angle sensor that detects a rotation angle of the shift lever, and transmits the rotation angle to the control device 28 as detection information of the operation position OP.

The magnetic sensor 65*a* detects the movement position of the movable rod 64*a* as described above, and transmits the actuator position AP (voltage value) to the control device 28 as detection information.

Further, the neutral detection unit 92 is provided on the shift shaft portion 74 as described above. The shift shaft portion 74 is connected to the transmission mechanism 24 (shift slider 42) via the operation shaft 62. Therefore, it can be said that the neutral detection unit 92 detects an actual shift range (actual neutral position) of the transmission mechanism 24. Therefore, hereinafter, the detection information of the neutral detection unit 92 is also referred to as an actual shift position RP.

Accordingly, during the operation of the outboard motor 10, the control device 28 acquires information about the operation position OP (rotation angle) from the operation position sensor 96, information about the actuator position AP from the magnetic sensor 65*a*, and information about the actual shift position RP (actual neutral position) from the neutral detection unit 92.

The notification unit 98 connected to the control device 28 is attached to an instrument panel or the like provided in the vicinity of an operator's seat of the outboard motor 10, is controlled by the control device 28, and provides various notifications to the user. The configuration of the notification unit 98 is not particularly limited, and may be at least one from among a display member, a sound output member, and a light emitting member (indicator or the like). For example, the display member may be a monitor provided on the instrument panel, or an indicator that lights up or blinks in error display. The sound output member may be a speaker, a buzzer, a loudspeaker or the like, and transmits an error by way of a warning sound or voice (words). The light emitting member may be a searchlight, a rotating warning light or the like. Furthermore, the notification unit 98 may be in the form of vibrations of a steering wheel of the outboard motor 10.

Then, when the program is executed, the control device 28 forms functional blocks of a shift control unit 100, a failure determination processing unit 102, and an actuator state monitoring unit 104.

The shift control unit 100 is a functional unit that controls the operation of the actuator 64. For example, the shift control unit 100 gives a command to a power distribution unit (not shown) based on the operation position OP (operation of the operating portion 94 by the user), to control electric power supplied from a battery 66 to the actuator 64. As an example, the power distribution unit adjusts the rotational moment of the motor of the actuator 64 by transmitting pulse power having an arbitrary duty ratio by PWM control in response to a command transmitted to the actuator 64 by the control device 28. Thus, the actuator 64 moves the movable rod 64*a* and maintains the movement position thereof.

The shift control unit 100 includes a target shift position setting unit 106 and an actuator drive control unit 108. The target shift position setting unit 106 sets target positions (the above-described first position, second position, and third position) of the movable rod 64*a* based on the information about the operation position OP detected by the operation position sensor 96. For example, when the operating portion 94 is operated from the neutral operation position to the forward operation position, the target shift position setting unit 106 sets the target position from the second position to the first position. When the operating portion 94 is operated from the neutral operation position to the reverse operation position, the target shift position setting unit 106 sets the target position from the second position to the third position. Further, when the operating portion 94 is operated from the forward operation position to the reverse operation position (or from the reverse operation position to the forward operation position), the target shift position setting unit 106 temporarily sets the target position to the second position, and sets the target position to the first or third position after the rotational speed of the engine 20 becomes equal to or lower than a predetermined value.

The actuator drive control unit 108 calculates the amount of electric power to be supplied to the actuator 64 based on the target position set by the target shift position setting unit 106, and gives a command to the power distribution unit. Further, the actuator drive control unit 108 may adjust (feed-back) the supplied electric power based on the actuator position AP acquired from the magnetic sensor 65*a*, when the actuator 64 is driven.

At the time of starting the outboard motor 10, the failure determination processing unit 102 of the control device 28 detects a failure of any of components related to the transmission mechanism 24 of the outboard motor 10, based on the information about the operation position OP and the information about the actual shift position RP. As the component (failure element) related to the transmission mechanism 24, for example, the shift mechanism 60 including the actuator 64, the neutral detection unit 92, the operation position sensor 96, or the like is assumed. That is, when the operation position OP and the actual shift position RP coincide with each other, it can be said that the components related to the transmission mechanism 24 are normal. When the operation position OP and the actual shift position RP do not coincide with each other, it can be inferred that an abnormality has occurred in any of the components related to the transmission mechanism 24.

Meanwhile, the actuator state monitoring unit 104 monitors the actual movement position of the movable rod 64*a* based on the actuator position AP detected by the magnetic sensor 65*a*, thereby performing processing for coping with various situations occurring in the outboard motor 10. The various situations include "shift disengagement" in which the dog clutch 48 is disengaged from the driven bevel gear 46 during forward movement or backward movement, and "shift bite" in which, contrary to the "shift disengagement", the dog clutch 48 deeply engages with the driven bevel gear 46 during forward movement or backward movement.

For example, during forward movement of the outboard motor 10 (when the transmission mechanism 24 is in the actual forward position), if the user performs an operation of reducing a throttle opening degree (an operation of bringing the operating portion 94 closer to the neutral operation position) in order to reduce the forward speed, there is a possibility that "shift disengagement" occurs. That is, when the forward speed becomes low, an action in which a teeth surface of the dog clutch 48 is pushed out by an inner teeth surface of the forward driven bevel gear 46*a* (an action in which the opposing teeth surfaces thereof abut against each other and repel each other) may occur. Thus, even if the operating portion 94 is not in the neutral operation position, the dog clutch 48 moves in a direction of disengaging from the forward driven bevel gear 46*a*. Incidentally, during backward movement of the outboard motor 10 (when the transmission mechanism 24 is in the actual reverse position), if the user performs an operation of reducing the throttle opening degree in order to reduce the backward speed, there is also a possibility that "shift disengagement" occurs.

Therefore, the actuator state monitoring unit 104 compares monitoring data 110 stored in the memory in advance with the acquired actuator position AP (voltage value). Then, a shift disengagement determination unit 112 estimates whether or not there is a possibility of occurrence of "shift disengagement".

Figure 4:
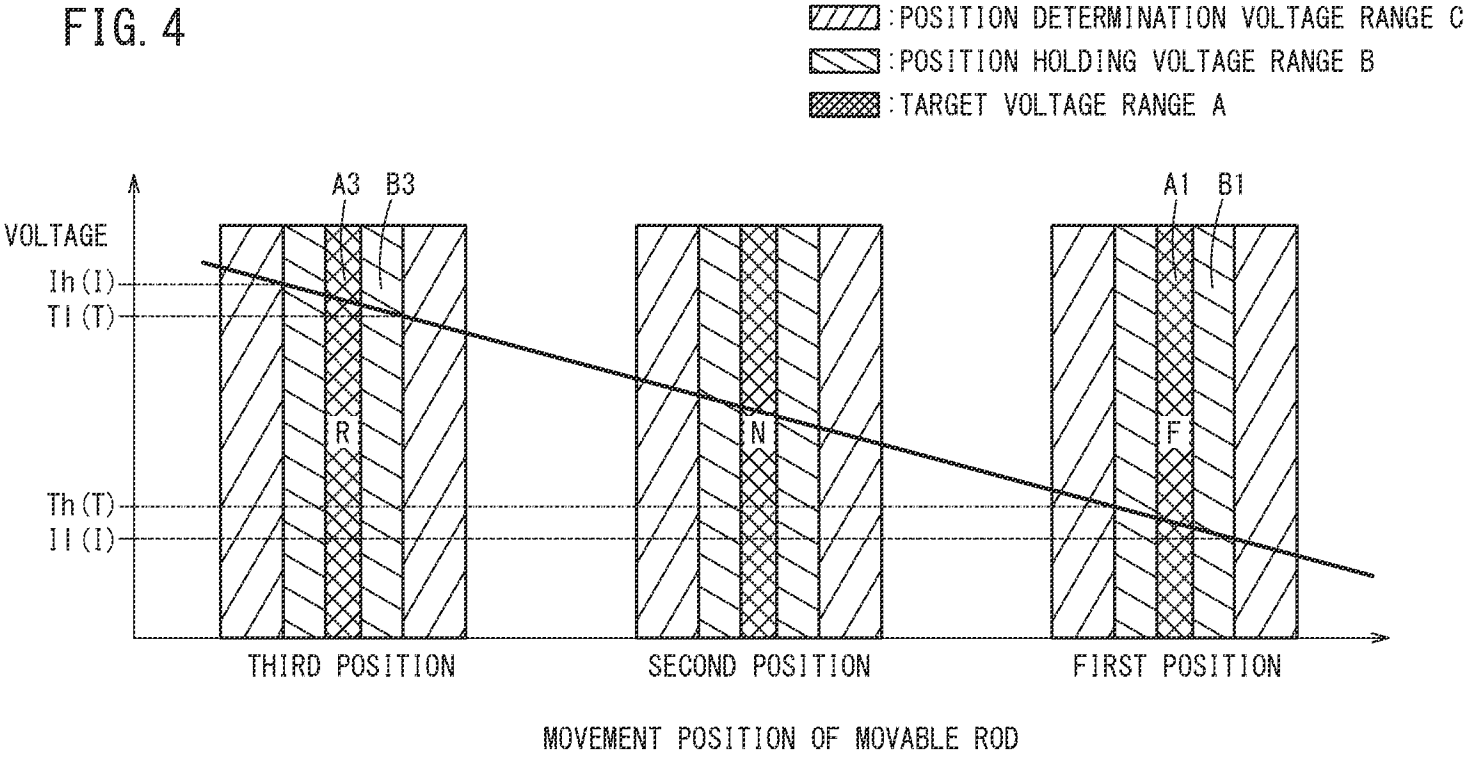
FIG. 4 is a graph showing a setting example of monitoring data.

As shown in FIG. 4, the magnetic sensor 65*a* provided in the actuator 64 detects a voltage value that linearly decreases in proportion to an amount of advance of the movable rod 64*a*. That is, the magnetic sensor 65*a* detects a low forward voltage value (for example, 1 V) when the movable rod 64*a* moves to the first position, detects an intermediate neutral voltage value (for example, 3 V) when the movable rod 64*a* moves to the second position, and detects a high reverse voltage value (for example, 5 V) when the movable rod 64*a* moves to the third position.

The actuator state monitoring unit 104 has the monitoring data 110 corresponding to the characteristics of the magnetic sensor 65*a*. In the monitoring data 110, a target voltage range A is set for each of the voltage values of the first to third positions. When the detection value of the magnetic sensor 65*a* is within the target voltage range A, the actuator state monitoring unit 104 considers that the movable rod 64*a* has reliably moved to the first to third positions. For example, the target voltage range A is set so as to have predetermined voltage margins (±0.1 V or the like) above and below each reference voltage value (the forward voltage value, the neutral voltage value, and the reverse voltage value).

Further, in the monitoring data 110, a position holding voltage range B is set for each of the voltage values of the first to third positions. The position holding voltage range B is a set value for monitoring the movement of the movable rod 64*a* in the "shift disengagement". For example, the position holding voltage range B is set so as to have voltage margins (±0.3 V or the like) smaller than those of a position determination voltage range C described later, above and below the reference voltage value.

Furthermore, in the monitoring data 110, the position determination voltage range C is set for each of the voltage values of the first to third positions. The position determination voltage range C is a value defining an engagement limit between the driven bevel gear 46 and the dog clutch 48 or a maintenance limit of the neutral position. For example, the position determination voltage range C is set so as to have voltage margins (±0.5 V or the like) corresponding to the specification of the transmission mechanism 24 or the shift mechanism 60, above and below the reference voltage value.

Based on the position holding voltage range B of the monitoring data 110, the shift disengagement determination unit 112 compares the actuator position AP with a shift disengagement threshold T during forward movement or backward movement. The shift disengagement threshold T is an upper limit value Th of a position holding voltage range B1 close to the neutral in the case of forward movement. The shift disengagement threshold T is a lower limit value Tl of a position holding voltage range B3 close to the neutral in the case of backward movement. That is, the shift disengagement determination unit 112 determines whether or not the voltage value that should be in a target voltage range A1 during forward movement is equal to or greater than the upper limit value Th, and determines that there is a possibility of occurrence of shift disengagement when the voltage value becomes equal to or greater than the upper limit value Th. Similarly, the shift disengagement determination unit 112 determines whether or not the voltage value that should be in a target voltage range A3 during backward movement is equal to or less than the lower limit value Tl, and determines that there is a possibility of occurrence of shift disengagement when the voltage value becomes equal to or less than the lower limit value Tl.

Further, a shift bite determination unit 114 of the actuator state monitoring unit 104 detects whether or not "shift bite" occurs during forward movement or backward movement, based on the position holding voltage range B of the monitoring data 110. Therefore, a shift bite threshold I is set in the monitoring data 110. The shift bite threshold I is a lower limit value Il of the position holding voltage range B1 in the case of forward movement, and is an upper limit value Ih of the position holding voltage range B3 in the case of backward movement.

The shift bite determination unit 114 determines whether or not the voltage value during forward movement is equal to or less than the lower limit value Il, and determines the occurrence of shift bite when the voltage value becomes equal to or less than the lower limit value Il. When the occurrence of the shift bite is determined, the shift bite determination unit 114 outputs an instruction not to control the actuator 64 (not to return the movement position to the target voltage range A1), to the shift control unit 100. That is, the shift bite state occurs due to an increase in the rotational speed or torque of the engine 20 during forward movement or backward movement, and is a state in which there is no rational problem. Therefore, the control device 28 continues to monitor the actuator position AP without returning the movement position of the movable rod 64*a* to the target voltage range A (without operating the actuator 64 as it is).

Further, the shift bite determination unit 114 determines whether or not the voltage value during backward movement is equal to or greater than the upper limit value Ih, and determines the occurrence of shift bite when the voltage value becomes equal to or greater than the upper limit value Ih. In this case as well, the shift bite determination unit 114 outputs an instruction not to control the actuator 64 (not to return to the target voltage range A3), to the shift control unit 100. With the above-described control, the actuator state monitoring unit 104 can satisfactorily cope with various situations occurring in the outboard motor 10.

The outboard motor 10 according to the present embodiment is basically configured as described above, and the operation thereof will be described below.

Figure 5:
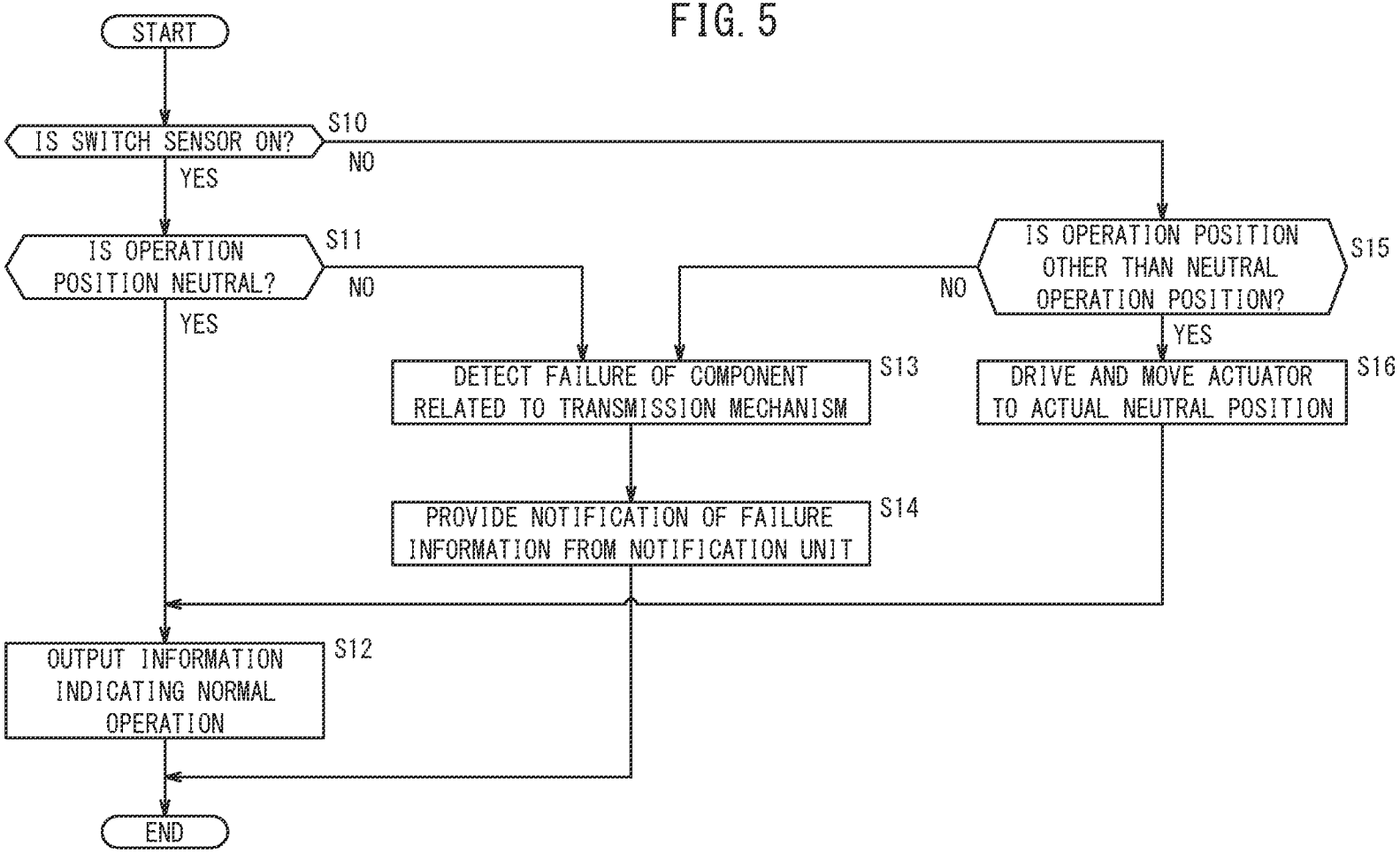
FIG. 5 is a flowchart showing a process flow of failure determination.

First, the failure determination at the time of starting the outboard motor 10 will be described with reference to the flowchart of FIG. 5. The control device 28 of the outboard motor 10 is activated when a starting operation is performed by the user, and automatically performs failure determination after being activated.

In the failure determination, the failure determination processing unit 102 determines ON/OFF of the switch sensor 92*c* based on the information about the actual shift position RP acquired from the neutral detection unit 92 (step S10). If the switch sensor 92*c* is ON (step S10: YES), the process proceeds to step S11, and if the switch sensor 92*c* is OFF (step S10: NO), the process proceeds to step S15.

In step S11, the failure determination processing unit 102 determines whether or not the operating portion 94 is in the neutral operation position, based on the operation position OP detected by the operation position sensor 96. When the operating portion 94 is in the neutral operation position (step S11: YES), the operation position coincides with the actual neutral position detected by the neutral detection unit 92, and the process proceeds to step S12. Accordingly, in step S12, the failure determination processing unit 102 outputs information indicating normal operation to the shift control unit 100. The shift control unit 100 transitions to control for performing shift switching corresponding to the operation of the operating portion 94.

On the other hand, when the operating portion 94 is in a position other than the neutral operation position (step S11: NO), it means that the operation position does not coincide with the actual neutral position detected by the neutral detection unit 92, and the process proceeds to step S13. Thus, in step S13, the failure determination processing unit 102 detects a failure of a component related to the transmission mechanism 24.

Then, the failure determination processing unit 102 provides notification of failure information from the notification unit 98 (step S14). When determining the occurrence of a failure, the control device 28 may perform an operation corresponding to the failure, such as stopping the engine 20 of the outboard motor 10 or not operating the actuator 64.

When the switch sensor 92*c* is OFF, in step S15, the failure determination processing unit 102 determines whether or not the operating portion 94 is in a position other than the neutral operation position, based on the operation position OP detected by the operation position sensor 96. When the operating portion 94 is in a position other than the neutral operation position (step S15: YES), the operation position matches the information of the neutral detection unit 92, and the process proceeds to step S16.

The outboard motor 10 is configured to rotate the engine 20 (drive shaft 22) when the transmission mechanism 24 is in the actual neutral position. Therefore, in step S16, the control device 28 notifies the user of the neutral operation via the notification unit 98, and in accordance with the neutral operation by the user, drives the actuator 64 to move the transmission mechanism 24 to the actual neutral position. Thereafter, the process proceeds to step S12, and the control device 28 transitions to control for performing shift switching corresponding to the operation of the operating portion 94, based on the information indicating the normal operation output by the failure determination processing unit 102.

On the other hand, when the operating portion 94 is in the neutral operation position (step S15: NO), it means that the operation position does not coincide with the position other than the actual neutral position detected by the neutral detection unit 92, and the above-described step S13 and step S14 are performed.

By executing the above-described failure determination processing flow at the time of starting the outboard motor 10, it is possible to recognize the failure of the shift mechanism 60 before navigation, and to suppress a malfunction during navigation.

Figure 6:
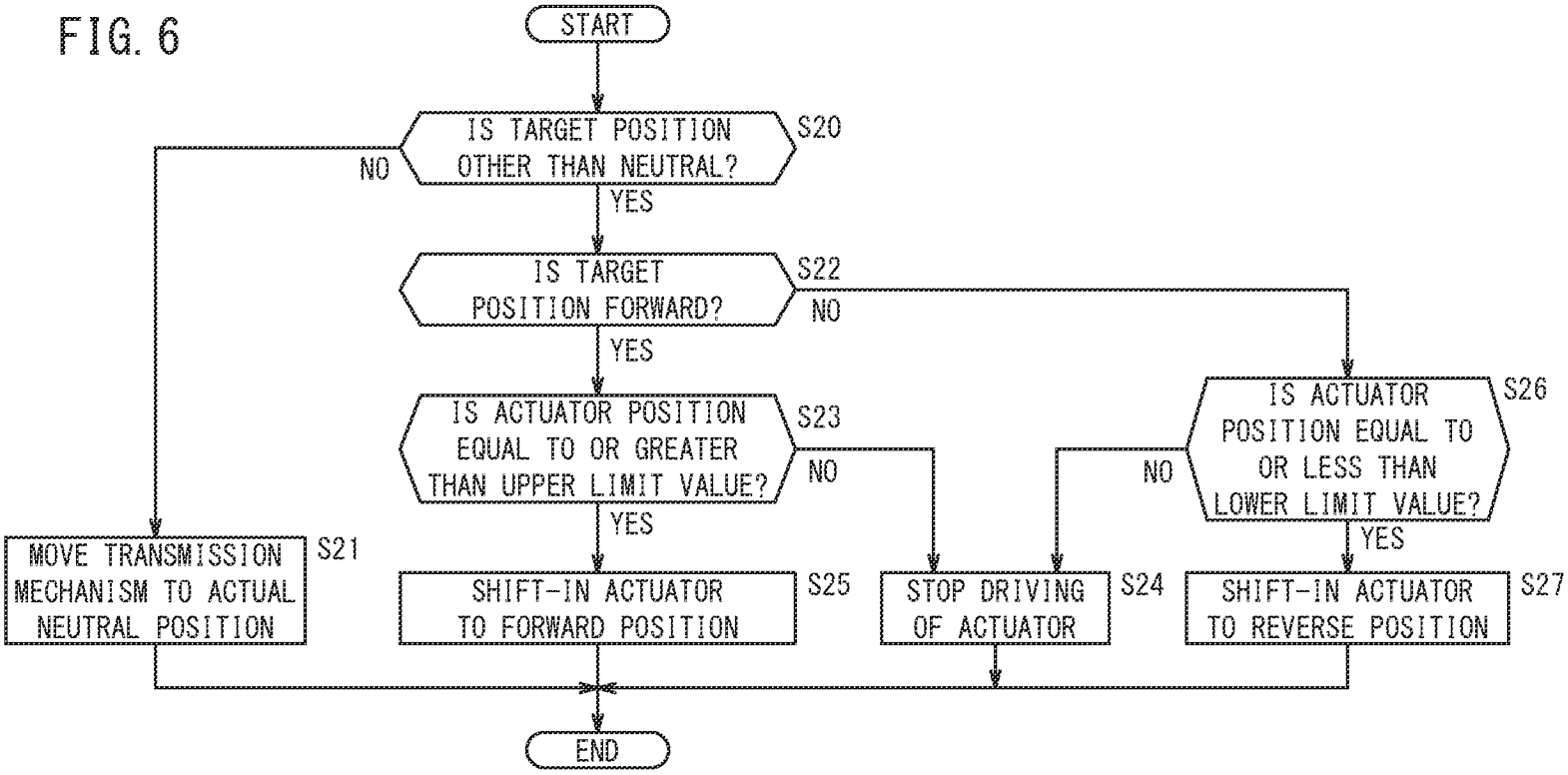
FIG. 6 is a flowchart showing a process flow of shift disengagement determination.

Next, the shift disengagement determination during navigation of the outboard motor 10 will be described with reference to the flowchart of FIG. 6. The control device 28 determines the possibility of occurrence of "shift disengagement" during forward movement or backward movement of the outboard motor 10, and performs processing to cope with this. The actuator state monitoring unit 104 acquires information about the target position from the target shift position setting unit 106 of the shift control unit 100, and determines whether or not the target position is other than neutral (second position) (step S20). When the target position is neutral, it is not necessary to take measures against "shift disengagement" in order to move the shift mechanism 60 to neutral. Therefore, when the target position is neutral (step S20: NO), the process proceeds to step S21, and the actuator 64 is driven to move the transmission mechanism 24 to the actual neutral position.

On the other hand, when the target position is other than neutral (step S20: YES), the process proceeds to step S22. In step S22, it is determined whether or not the target position is forward (second position), and if the target position is forward (step S22: YES), the process proceeds to step S23, and if the target position is not forward (step S22: NO), the process proceeds to step S26.

In step S23, the actuator state monitoring unit 104 compares the acquired actuator position AP (voltage value) with the monitoring data 110, and determines whether or not the actuator position AP is equal to or greater than the upper limit value Th of the position holding voltage range B1. When the actuator position AP is lower than the upper limit value Th (step S23: NO), the process proceeds to step S24. In this case, it can be said that no shift disengagement occurs and the forward driven bevel gear 46*a* and the dog clutch 48 are in the engagement direction. Therefore, in step S24, the actuator state monitoring unit 104 outputs a command not to drive the actuator 64 to the shift control unit 100, and the shift control unit 100 stops driving of the actuator 64 (drive mechanism 64*c*) based on this command.

On the other hand, when it is determined that the actuator position AP is equal to or greater than the upper limit value Th (step S23: YES), the process proceeds to step S25. In this case, it can be said that there is a possibility of occurrence of shift disengagement. Therefore, in step S25, the actuator state monitoring unit 104 outputs, to the shift control unit 100, a drive command to move (shift-in) the actuator 64 to the forward position, and the shift control unit 100 advances the actuator 64 based on this command. As a result, the dog clutch 48 moves in a direction of engaging with the forward driven bevel gear 46*a* based on the operation of the shift mechanism 60, and it is possible to satisfactorily continue forward movement of the hull Sh.

If the target position is not forward in step S22 (step S22: NO), it means that the target position is reverse (third position). Therefore, in step S26, the actuator state monitoring unit 104 compares the acquired actuator position AP with the monitoring data 110, and determines whether or not the actuator position AP is equal to or less than the lower limit value Tl of the position holding voltage range B3. When the actuator position AP is higher than the lower limit value Tl (step S26: NO), the process proceeds to step S24. In this case, it can be said that shift disengagement does not occur and the backward driven bevel gear 46*b* and the dog clutch 48 are in the engagement direction. Therefore, the above-described step S24 is performed to stop the actuator 64 (drive mechanism 64*c*).

On the other hand, when it is determined that the actuator position AP is equal to or less than the lower limit value Tl (step S26: YES), the process proceeds to step S27. In this case, it can be said that there is a possibility of occurrence of shift disengagement. Therefore, in step S27, the actuator state monitoring unit 104 outputs, to the shift control unit 100, an instruction to move (shift-in) the actuator 64 to the reverse position, and the shift control unit 100 moves the actuator 64 backward based on this instruction. As a result, the dog clutch 48 moves in the direction of engaging with the backward driven bevel gear 46*b* based on the operation of the shift mechanism 60, and it is possible to satisfactorily continue the backward movement of the hull Sh.

The present invention is not limited to the above-described embodiment, and various modifications can be made without departing from the spirit of the invention. For example, in the shift disengagement determination, a deviation of the actuator position AP (voltage value) from the target voltage range A may be calculated, and the amount of electric power to be supplied to the actuator 64 may be set according to the deviation.

The operation position sensor 96 that detects the operation position OP of the operating portion 94 is not limited to a sensor that detects the rotation angle of the shift lever. For example, a dial type, button type, or other type operating portion can be adopted, in addition to the shift lever, as the operating portion 94. As the operation position sensor 96, an appropriate sensor can be applied according to the configuration of the operating portion 94.

The shift position detection unit 91 that detects the actual shift position RP of the transmission mechanism 24 may also have various configurations. For example, the shift position detection unit 91 may be a detection unit that detects all shift ranges (forward, neutral, and reverse) of the transmission mechanism 24.

The actuator detection unit 65 that detects the state of the actuator 64 is also not limited to the magnetic sensor 65*a*, and may have various configurations. For example, the state of the actuator 64 (the movement position of the movable rod 64*a*) can be recognized also by a detection unit that detects the state of electric power supplied to the actuator 64.

Technical ideas and advantages understandable from the above-mentioned embodiment will be described below.

An aspect of the present invention is an outboard motor 10 including an actuator 64 configured to operate based on an operation of an operating portion 94 performed by a user, and a transmission mechanism 24 configured to change a rotational output of an internal combustion engine (engine 20) based on an operation of the actuator 64, the outboard motor 10 comprising an operation position detection unit (operation position sensor 96) configured to detect an operation position OP of the operating portion 94, a shift position detection unit 91 configured to detect an actual shift position RP of the transmission mechanism 24, an actuator detection unit 65 configured to detect a state of the actuator 64, and a control unit (control device 28) configured to acquire the operation position OP, the actual shift position RP, and the state of the actuator 64 (an actuator position AP), which are pieces of detection information, to perform processing, wherein the control unit performs failure determination or drive control of the actuator 64 based on at least two pieces of detection information among the pieces of detection information.

In the outboard motor 10, the control unit (control device 28) acquires the operation position OP, the actual shift position RP, and the state of the actuator 64 to perform processing, whereby the shift state can be more satisfactorily monitored. In particular, the control unit performs failure determination or drive control of the actuator 64 based on at least two pieces of detection information among the detection of the operation position OP, the detection of the actual shift position RP, and the detection of the state of the actuator 64. Therefore, it is possible to satisfactorily perform detection of a failure of a component related to the transmission mechanism 24, maintenance of the state of the transmission mechanism 24, and the like. Accordingly, the outboard motor 10 can perform control corresponding to various situations.

The operation position OP detected by the operation position detection unit (operation position sensor 96) is information about a rotation angle obtained when the operating portion 94 is rotationally operated, the actual shift position RP detected by the shift position detection unit 91 is information indicating detection or non-detection of an actual neutral position by a neutral detection unit 92, and the state of the actuator 64 detected by the actuator detection unit 65 is information related to a movement position of a movable portion (movable rod 64*a*) of the actuator 64. The control unit (control device 28) can more accurately monitor the shift state by using the information about the rotation angle, the information indicating the detection or non-detection of the actual neutral position, and the information about the movement position of the movable portion.

When the operation position OP is a neutral operation position and the actual neutral position is detected, or when the operation position OP is a position other than the neutral operation position and the actual neutral position is not detected, the control unit (control device 28) determines that a component related to the transmission mechanism 24 is normal, and when the operation position OP is the neutral operation position and the actual neutral position is not detected, or when the operation position OP is a position other than the neutral operation position and the actual neutral position is detected, the control unit determines that a failure has occurred in the component related to the transmission mechanism 24. Accordingly, the control unit can easily determine occurrence of a failure in the component related to the transmission mechanism 24.

The outboard motor 10 includes a notification unit 98 configured to, when the control unit (control device 28) determines that the failure has occurred in the component related to the transmission mechanism 24, notify the user of occurrence of the failure in the component related to the transmission mechanism 24. As a result, the outboard motor 10 can smoothly notify the user that the occurrence of a failure has been determined, and the user can quickly take necessary measures.

The notification unit 98 is formed of at least one from among a display member, a sound output member, and a light emitting member. Thus, the user can easily recognize the occurrence of the failure.

The control unit (control device 28) determines occurrence of the failure in the component related to the transmission mechanism 24 at a time of starting the outboard motor 10. As a result, the user can recognize the failure at the time of starting the outboard motor 10, and can take measures such as maintenance of the outboard motor 10 and stopping of navigation.

Further, in a case where a target position of engagement of a clutch (dog clutch 48) with a gear (driven bevel gear 46) is set based on the operation position OP in order to move forward or move backward, the control unit (control device 28) monitors the state of the actuator 64 to determine whether or not a possibility of occurrence of shift disengagement in the transmission mechanism 24 exists, stops driving of the actuator 64 when the possibility of the occurrence of the shift disengagement does not exist, and drives the actuator 64 to continue a shift state of the transmission mechanism 24 when the possibility of the occurrence of the shift disengagement exists. As a result, the outboard motor 10 can push the actuator 64 in the gear-in direction to prevent the shift disengagement when there is a possibility of the occurrence of the shift disengagement in the transmission mechanism 24.

Further, the state of the actuator 64 detected by the actuator detection unit 65 is a voltage value, the control unit (control device 28) includes monitoring data 110 for monitoring the voltage value, and the monitoring data 110 includes a target voltage range A corresponding to a position, set in advance, in the operation of the actuator 64 and includes, outside the target voltage range A, a threshold (shift disengagement threshold T) for determining the shift disengagement. Thus, the outboard motor 10 can satisfactorily monitor the state of the transmission mechanism 24 based on the voltage value detected by the actuator detection unit 65 and the monitoring data 110.

Further, in a case where a target position of engagement of the clutch (dog clutch 48) with the gear (driven bevel gear 46) is set based on the operation position OP in order to move forward or move backward, the control unit (control device 28) monitors the state of the actuator 64, and when detecting that shift engagement in the transmission mechanism 24 becomes deep, the control unit stops the actuator 64. In the outboard motor 10, the engagement between the dog clutch 48 and the driven bevel gear 46 may become deeper due to, for example, an increase in the rotational speed or torque of the engine 20. However, by stopping the actuator 64 at the time of deep engagement, unnecessary control is not required.

What is claim is:

1. An outboard motor including an actuator configured to operate based on an operation of an operating portion performed by a user, and a transmission mechanism configured to change a rotational output of an internal combustion engine based on an operation of the actuator, the outboard motor comprising:

an operation position detection unit configured to detect an operation position of the operating portion;

a shift position detection unit configured to detect an actual shift position of the transmission mechanism;

an actuator detection unit configured to detect a state of the actuator; and a control unit configured to acquire the operation position, the actual shift position, and the state of the actuator, which are pieces of detection information, to perform processing, wherein the control unit performs failure determination or drive control of the actuator based on at least two pieces of detection information among the pieces of detection information, and the control unit determines occurrence of the failure in the component related to the transmission mechanism at a time of starting the outboard motor.

2. The outboard motor according to claim 1, wherein the operation position detected by the operation position detection unit is information about a rotation angle obtained when the operating portion is rotationally operated, the actual shift position detected by the shift position detection unit is information indicating detection or non-detection of an actual neutral position by a neutral detection unit, and the state of the actuator detected by the actuator detection unit is information related to a movement position of a movable portion of the actuator.

3. The outboard motor according to claim 2, wherein when the operation position is a neutral operation position and the actual neutral position is detected, or when the operation position is a position other than the neutral operation position and the actual neutral position is not detected, the control unit determines that a component related to the transmission mechanism is normal, and when the operation position is the neutral operation position and the actual neutral position is not detected, or when the operation position is a position other than the neutral operation position and the actual neutral position is detected, the control unit determines that a failure has occurred in the component related to the transmission mechanism.

4. The outboard motor according to claim 3, further comprising a notification unit configured to, when the control unit determines that the failure has occurred in the component related to the transmission mechanism, notify the user of occurrence of the failure in the component related to the transmission mechanism.

5. The outboard motor according to claim 4, wherein the notification unit is formed of at least one from among a display member, a sound output member, and a light emitting member.

6. An outboard motor including an actuator configured to operate based on an operation of an operating portion performed by a user, and a transmission mechanism configured to change a rotational output of an internal combustion engine based on an operation of the actuator, the outboard motor comprising:

an operation position detection unit configured to detect an operation position of the operating portion;

a shift position detection unit configured to detect an actual shift position of the transmission mechanism;

an actuator detection unit configured to detect a state of the actuator; and a control unit configured to acquire the operation position, the actual shift position, and the state of the actuator, which are pieces of detection information, to perform processing, wherein the control unit performs failure determination or drive control of the actuator based on at least two pieces of detection information among the pieces of detection information, wherein in a case where a target position of engagement of a clutch with a gear is set based on the operation position in order to move forward or move backward, the control unit monitors the state of the actuator to determine whether or not a possibility of occurrence of shift disengagement in the transmission mechanism exists, stops driving of the actuator when the possibility of the occurrence of the shift disengagement does not exist, and drives the actuator to continue a shift state of the transmission mechanism when the possibility of the occurrence of the shift disengagement exists.

7. The outboard motor according to claim 6, wherein the state of the actuator detected by the actuator detection unit is a voltage value, the control unit includes monitoring data for monitoring the voltage value, and the monitoring data includes a target voltage range corresponding to a position, set in advance, in the operation of the actuator and includes, outside the target voltage range, a threshold for determining the shift disengagement.

8. An outboard motor including an actuator configured to operate based on an operation of an operating portion performed by a user, and a transmission mechanism configured to change a rotational output of an internal combustion engine based on an operation of the actuator, the outboard motor comprising:

an operation position detection unit configured to detect an operation position of the operating portion;

a shift position detection unit configured to detect an actual shift position of the transmission mechanism;

an actuator detection unit configured to detect a state of the actuator; and a control unit configured to acquire the operation position, the actual shift position, and the state of the actuator, which are pieces of detection information, to perform processing, wherein the control unit performs failure determination or drive control of the actuator based on at least two pieces of detection information among the pieces of detection information, wherein in a case where a target position of engagement of a clutch with a gear is set based on the operation position in order to move forward or move backward, the control unit monitors the state of the actuator, and when detecting that shift engagement in the transmission mechanism becomes deep, the control unit stops the actuator.

* * * * *